US008839581B2

(12) United States Patent
Hohmann, Jr.

(10) Patent No.: US 8,839,581 B2
(45) **Date of Patent: *Sep. 23, 2014**

(54) HIGH-STRENGTH PARTIALLY COMPRESSED LOW PROFILE VENEER TIE AND ANCHORING SYSTEM UTILIZING THE SAME

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/620,914

(22) Filed: Sep. 15, 2012

(65) Prior Publication Data

US 2014/0075879 A1 Mar. 20, 2014

(51) Int. Cl.
*E04B 1/38* (2006.01)

(52) U.S. Cl.
USPC ..... 52/379; 52/712; 52/713; 52/513

(58) Field of Classification Search
CPC ..... E04B 1/4178; E04B 1/4185; E04B 2/30; E04B 2001/405; E04B 2001/4192; E04B 2002/0282; E04H 9/02; E04C 5/18
USPC ..... 52/379, 712, 713, 506.01, 426, 513
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| 1,794,684 | A | 3/1931 | Handel |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |
| 2,605,867 | A | 8/1952 | Goodwin |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

ASTM Standard A-951, Standard Specification for Steel Wire for Masonry Joint Reinforcement, Nov. 14, 2011, Table 1, 6 pages, West Conshohocken, Pennsylvania, United States.

(Continued)

*Primary Examiner* — Brent W Herring
(74) *Attorney, Agent, or Firm* — Silber & Fridman

(57) ABSTRACT

A high-strength low profile partially compressed pintle veneer tie and anchoring system employing the same is disclosed. The high-strength pintle anchoring system employs a partially compressively reduced veneer tie that is cold-worked with the resultant body partially having substantially semicircular edges and flat surfaces therebetween. The edges are aligned to receive compressive forces transmitted from the outer wythe. The partially compressively reduced veneer tie, when part of the anchoring system, interengages with the receptor portions of a wall anchor and is dimensioned to preclude significant veneer tie movement. The insertion portion of the veneer tie is compressed and patterned to ensure a secure hold within the bed joint.

21 Claims, 7 Drawing Sheets

(56) References Cited

U.S. PATENT DOCUMENTS

| | | | |
|---|---|---|---|
| 2,780,936 | A | 2/1957 | Hillberg |
| 2,929,238 | A | 3/1960 | Kaye |
| 2,966,705 | A | 1/1961 | Massey |
| 2,999,571 | A | 9/1961 | Huber |
| 3,030,670 | A | 4/1962 | Bigelow |
| 3,183,628 | A | 5/1965 | Smith |
| 3,254,736 | A | 6/1966 | Gass |
| 3,277,626 | A | 10/1966 | Brynjolfsson et al. |
| 3,300,939 | A | 1/1967 | Brynjolfsson et al. |
| 3,309,828 | A | 3/1967 | Tribble |
| 3,310,926 | A | 3/1967 | Brandreth et al. |
| 3,341,998 | A | 9/1967 | Lucas |
| 3,377,764 | A | 4/1968 | Storch |
| 3,478,480 | A | 11/1969 | Swenson |
| 3,563,131 | A | 2/1971 | Ridley, Sr. |
| 3,568,389 | A | 3/1971 | Gulow |
| 3,640,043 | A | 2/1972 | Querfeld et al. |
| 3,964,226 | A | 6/1976 | Hala et al. |
| 3,964,227 | A | 6/1976 | Hala |
| 4,021,990 | A | 5/1977 | Schwalberg |
| 4,227,359 | A | 10/1980 | Schlenker |
| 4,238,987 | A | 12/1980 | Siebrecht-Reuter |
| 4,305,239 | A | 12/1981 | Geraghty |
| 4,373,314 | A | 2/1983 | Allan |
| 4,382,416 | A | 5/1983 | Kellogg-Smith |
| 4,424,745 | A | 1/1984 | Magorian et al. |
| 4,438,611 | A | 3/1984 | Bryant |
| 4,473,984 | A | 10/1984 | Lopez |
| 4,482,368 | A | 11/1984 | Roberts |
| 4,571,909 | A | 2/1986 | Berghuis et al. |
| 4,596,102 | A | 6/1986 | Catani et al. |
| 4,598,518 | A | 7/1986 | Hohmann |
| 4,606,163 | A | 8/1986 | Catani |
| 4,628,657 | A | 12/1986 | Ermer et al. |
| 4,636,125 | A | 1/1987 | Burgard |
| 4,640,848 | A | 2/1987 | Cerdan-Diaz et al. |
| 4,660,342 | A | 4/1987 | Salisbury |
| 4,703,604 | A | 11/1987 | Muller |
| 4,708,551 | A | 11/1987 | Richter et al. |
| 4,738,070 | A | 4/1988 | Abbott et al. |
| 4,764,069 | A | 8/1988 | Reinwall et al. |
| 4,819,401 | A | 4/1989 | Whitney, Jr. |
| 4,827,684 | A | 5/1989 | Allan |
| 4,843,776 | A | 7/1989 | Guignard |
| 4,852,320 | A | 8/1989 | Ballantyne |
| 4,869,038 | A | 9/1989 | Catani |
| 4,869,043 | A | 9/1989 | Hatzinikolas et al. |
| 4,875,319 | A | 10/1989 | Hohmann |
| 4,911,949 | A | 3/1990 | Iwase et al. |
| 4,922,680 | A | 5/1990 | Kramer et al. |
| 4,946,632 | A | 8/1990 | Pollina |
| 4,955,172 | A | 9/1990 | Pierson |
| 5,063,722 | A | 11/1991 | Hohmann |
| 5,099,628 | A | 3/1992 | Noland et al. |
| 5,207,043 | A | 5/1993 | McGee et al. |
| 5,307,602 | A | 5/1994 | Lebraut |
| 5,392,581 | A | 2/1995 | Hatzinikolas et al. |
| 5,408,798 | A | 4/1995 | Hohmann |
| 5,440,854 | A | 8/1995 | Hohmann |
| 5,454,200 | A | 10/1995 | Hohmann |
| 5,456,052 | A | 10/1995 | Anderson et al. |
| 5,490,366 | A | 2/1996 | Burns et al. |
| 5,598,673 | A | 2/1997 | Atkins |
| 5,634,310 | A | 6/1997 | Hohmann |
| 5,669,592 | A | 9/1997 | Kearful |
| 5,671,578 | A | 9/1997 | Hohmann |
| 5,673,527 | A | 10/1997 | Coston et al. |
| 5,755,070 | A | 5/1998 | Hohmann |
| 5,816,008 | A | 10/1998 | Hohmann |
| 5,819,486 | A | 10/1998 | Goodings |
| 5,845,455 | A | 12/1998 | Johnson, III |
| 6,000,178 | A | 12/1999 | Goodings |
| 6,125,608 | A | 10/2000 | Charlson |
| 6,209,281 | B1 | 4/2001 | Rice |
| 6,279,283 | B1 | 8/2001 | Hohmann et al. |
| 6,284,311 | B1 | 9/2001 | Gregorovich et al. |
| 6,332,300 | B1 | 12/2001 | Wakai |
| 6,351,922 | B1 | 3/2002 | Burns et al. |
| 6,367,219 | B1 | 4/2002 | Quinlan |
| 6,612,343 | B2 | 9/2003 | Camberlin et al. |
| 6,627,128 | B1 | 9/2003 | Boyer |
| 6,668,505 | B1 | 12/2003 | Hohmann et al. |
| 6,686,301 | B2 | 2/2004 | Li et al. |
| 6,735,915 | B1 | 5/2004 | Johnson, III |
| 6,739,105 | B2 | 5/2004 | Fleming |
| 6,789,365 | B1 | 9/2004 | Hohmann et al. |
| 6,817,147 | B1 | 11/2004 | MacDonald |
| 6,827,969 | B1 | 12/2004 | Skoog et al. |
| 6,837,013 | B2 | 1/2005 | Foderberg et al. |
| 6,851,239 | B1 | 2/2005 | Hohmann et al. |
| 6,925,768 | B2 | 8/2005 | Hohmann et al. |
| 6,941,717 | B2 | 9/2005 | Hohmann et al. |
| 6,968,659 | B2 | 11/2005 | Boyer |
| 7,007,433 | B2 | 3/2006 | Boyer |
| 7,017,318 | B1 | 3/2006 | Hohmann et al. |
| 7,043,884 | B2 | 5/2006 | Moreno |
| 7,059,577 | B1 | 6/2006 | Burgett |
| D527,834 | S | 9/2006 | Thimons et al. |
| 7,147,419 | B2 | 12/2006 | Balbo Di Vinadio |
| 7,152,382 | B2 | 12/2006 | Johnson, III |
| 7,171,788 | B2 | 2/2007 | Bronner |
| 7,178,299 | B2 | 2/2007 | Hyde et al. |
| D538,948 | S | 3/2007 | Thimons et al. |
| 7,225,590 | B1 | 6/2007 | diGirolamo et al. |
| 7,325,366 | B1 | 2/2008 | Hohmann, Jr. et al. |
| 7,334,374 | B2 | 2/2008 | Schmid |
| 7,374,825 | B2 | 5/2008 | Hazel et al. |
| 7,415,803 | B2 | 8/2008 | Bronner |
| 7,481,032 | B2 | 1/2009 | Tarr |
| 7,552,566 | B2 | 6/2009 | Hyde et al. |
| 7,562,506 | B2 | 7/2009 | Hohmann, Jr. |
| 7,587,874 | B2 | 9/2009 | Hohmann, Jr. |
| 7,735,292 | B2 | 6/2010 | Massie |
| 7,748,181 | B1 | 7/2010 | Guinn |
| 7,788,869 | B2 | 9/2010 | Voegele, Jr. |
| D626,817 | S | 11/2010 | Donowho et al. |
| 7,845,137 | B2 | 12/2010 | Hohmann, Jr. |
| 8,037,653 | B2 | 10/2011 | Hohmann, Jr. |
| 8,051,619 | B2 | 11/2011 | Hohmann, Jr. |
| 8,096,090 | B1 | 1/2012 | Hohmann, Jr. et al. |
| 8,109,706 | B2 | 2/2012 | Richards |
| 8,122,663 | B1 | 2/2012 | Hohmann, Jr. et al. |
| 8,201,374 | B2 | 6/2012 | Hohmann, Jr. |
| 8,209,934 | B2 | 7/2012 | Pettingale |
| 8,215,083 | B2 | 7/2012 | Toas et al. |
| 8,291,672 | B2 | 10/2012 | Hohmann, Jr. et al. |
| 8,347,581 | B2 | 1/2013 | Doerr et al. |
| 8,375,667 | B2 | 2/2013 | Hohmann, Jr. |
| 8,418,422 | B2 | 4/2013 | Johnson, III |
| 8,511,041 | B2 | 8/2013 | Fransen |
| 8,516,763 | B2 | 8/2013 | Hohmann, Jr. |
| 8,516,768 | B2 | 8/2013 | Johnson, III |
| 8,544,228 | B2 | 10/2013 | Bronner |
| 8,555,587 | B2 | 10/2013 | Hohmann, Jr. |
| 8,555,596 | B2 | 10/2013 | Hohmann, Jr. |
| 8,596,010 | B2 | 12/2013 | Hohmann, Jr. |
| 8,613,175 | B2 | 12/2013 | Hohmann, Jr. |
| 8,667,757 | B1 | 3/2014 | Hohmann, Jr. |
| 2001/0054270 | A1 | 12/2001 | Rice |
| 2002/0100239 | A1 | 8/2002 | Lopez |
| 2003/0121226 | A1 | 7/2003 | Bolduc |
| 2004/0083667 | A1 | 5/2004 | Johnson, III |
| 2004/0216408 | A1 | 11/2004 | Hohmann, Jr. |
| 2004/0216413 | A1 | 11/2004 | Hohmann et al. |
| 2004/0216416 | A1 | 11/2004 | Hohmann et al. |
| 2004/0231270 | A1 | 11/2004 | Collins et al. |
| 2005/0279043 | A1 | 12/2005 | Bronner |
| 2006/0005490 | A1 | 1/2006 | Hohmann, Jr. |
| 2006/0198717 | A1 | 9/2006 | Fuest |
| 2006/0242921 | A1 | 11/2006 | Massie |
| 2006/0251916 | A1 | 11/2006 | Arikawa et al. |
| 2008/0092472 | A1 | 4/2008 | Doerr et al. |
| 2008/0141605 | A1 | 6/2008 | Hohmann |
| 2008/0222992 | A1 | 9/2008 | Hikai et al. |

(56) References Cited

U.S. PATENT DOCUMENTS

| | | | | |
|---|---|---|---|---|
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0277397 | A1 | 11/2011 | Hohmann, Jr. | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0074435 | A1* | 3/2013 | Hohmann, Jr. | 52/565 |
| 2013/0074442 | A1* | 3/2013 | Hohmann, Jr. | 52/712 |
| 2013/0232893 | A1 | 9/2013 | Hohmann, Jr. | |
| 2013/0232909 | A1 | 9/2013 | Curtis et al. | |
| 2013/0247482 | A1* | 9/2013 | Hohmann, Jr. | 52/167.1 |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1* | 1/2014 | Hohmann, Jr. | 52/699 |
| 2014/0075855 | A1* | 3/2014 | Hohmann, Jr. | 52/167.1 |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Inc.; Product Catalog, 2003, 44 pages, Hauppauge, New York, United States.

Hohmann & Barnard, Inc.; Product Catalog, 2013, 52 pages, Hauppauge, New York, United States.

Jan Kosny, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

Building Envelope Requirements, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2009, 52 pages, Hauppauge, New York, United States.

* cited by examiner

HIGH-STRENGTH PARTIALLY COMPRESSED LOW PROFILE VENEER TIE AND ANCHORING SYSTEM UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, specially dimensioned veneer ties with high strength partially compressed pintles and a low profile insertion portion. The veneer ties are for emplacement in the outer wythe and are further accommodated by receptors in the cavity, which receptors extend from the inner wythe to encapture the specially configured veneer ties. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer. Anchors and ties are generally placed in one of the following five categories: corrugated; sheet metal; wire; two-piece adjustable; or joint reinforcing. The present invention has a focus on wire formatives and in particular, pintle ties.

Prior tests have shown that failure of anchoring systems frequently occurs at the juncture between the pintle of the veneer tie and the receptor portion of the wall anchor. This invention addresses the need for a high-strength pintle suitable for use with either a masonry block or dry wall construction that provides a strong pintle-to-receptor connection.

Early in the development of high-strength anchoring systems a prior patent, namely U.S. Pat. No. 4,875,319 ('319), to Ronald P. Hohmann, in which a molded plastic clip is described as tying together a reinforcing wire and a veneer tie. The assignee of '319, Hohmann & Barnard, Inc., now a MiTek-Berkshire Hathaway company, successfully commercialized the device under the SeismiClip trademark. For many years, the white plastic clip tying together the veneer anchor and the reinforcement wire in the outer wythe has been a familiar item in commercial seismic-zone buildings. Additionally, the high-strength pintle hereof has been combined with the swaged leg as shown in the inventor's patent, U.S. Pat. No. 7,325,366. The combination item reduces the number of "bits and pieces" brought to the job site and simplifies installation.

The high-strength partially compressed pintle is specially configured to prevent veneer tie pullout. The configured pintle restricts movement and ensures a high-strength connection and transfer of forces between the veneer and the backup wall. The wire formative insertion portion for disposition within the outer wythe, is compressively reduced in height by the cold-working thereof and compressively patterned to securely hold to the mortar joint and increase the veneer tie strength. The close control of overall heights permits the mortar of the bed joints to flow over and about the veneer ties. Because the wire formative hereof employs extra strong material and benefits from the cold-working of the metal alloys, the high-span anchoring system meets the unusual requirements demanded in current building structures. Reinforcement wires are included to form seismic constructs.

There have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Because of this, the veneer facing material is tied down over a span of two or more times that which had previously been experienced. Exemplary of the public sector building specification is that of the *Energy Code Requirement*, Boston, Mass. (See Chapter 13 of 780 CMR, Seventh Edition). This Code sets forth insulation R-values well in excess of prior editions and evokes an engineering response opting for thicker insulation and correspondingly larger cavities.

The use of wire formatives in cavity wall construction have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block to protect against wythe separation. A balancing of mortar and wire formatives needs to be struck to ensure veneer tie stability within the outer wythe. The present high strength partially compressed veneer tie greatly assists in maintaining this balance in the mortar joint.

Besides earthquake protection requiring high-strength anchoring systems, the failure of several high-rise buildings to withstand wind and other lateral forces has resulted in the promulgation of more stringent Uniform Building Code provisions. This high-strength partially compressively reduced veneer tie is a partial response thereto. The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,454,200 | Hohmann | Oct. 3, 1995 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann | Mar. 28, 2006 |
| 7,325,366 | Hohmann | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,869,038—M. J. Catani—Issued Sep. 26, 1989 Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,875,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,454,200—R. Hohmann—Issued October 1995 Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003 Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,785,365—R. Hohmann et al.—Issued Sep. 14, 2004 Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005 Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006 Discloses an anchoring system with low-profile wall ties in which insertion portions of the wall anchor and the veneer anchor are compressively reduced in height.

U.S. Pat. No. 7,325,366—Hohmann—Issued Feb. 5, 2008 Discloses snap-in veneer ties for a seismic construction system in cooperation with low-profile, high-span wall anchors.

None of the above anchors or anchoring systems provide a veneer tie having a low profile high-strength partially compressively reduced veneer tie for fulfilling the need for enhanced compressive and tensile properties. This invention relates to an improved anchoring arrangement for use in conjunction with cavity walls having an inner wythe and an outer wythe and meets the heretofore unmet need described above.

SUMMARY

In general terms, the invention disclosed hereby is a low profile, high-strength wire formative pintle veneer tie with compressed portions and an anchoring system utilizing the same for cavity walls having an inner and outer wythe. The system includes a wire-formative veneer tie for emplacement in the outer wythe. The high-strength construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a wire veneer tie, and, optionally, a continuous wire reinforcement is provided. The invention contemplates that the high-strength partially compressively reduced veneer ties are wire formatives depending into the wall cavity for connections between the veneer tie and the wall anchor. The insertion portions of the wire formative veneer ties are compressively reduced in height by the cold-working thereof and compressively patterned to securely hold to the mortar joint and increase the veneer tie strength. The close control of overall heights permits the mortar of the bed joints to flow over and about the veneer ties.

In this invention, the veneer tie is constructed from a wire formative and has compressed interengaging portions that provide a high strength connection, restricting veneer tie movement and pullout, when interconnected with a wall anchor and embedded in the bed joint of the outer wythe. The veneer tie has a patterned insertion portion to better secure the tie within the bed joint. In the first embodiment, the veneer tie is engaged with a wall anchor that is interconnected with a ladder- or truss-type reinforcement in a manner similar to the wall anchor shown in Hohmann, U.S. Pat. No. 6,789,365. The anchor has two configurations with either a single eye or two eyes extending from the receptor portions into the cavity between the wythes. Each eye accommodates the interengagement therewith of the high-strength pintles of the veneer ties.

The second embodiment includes a dry wall construct inner wythe. Here, the dry-wall anchor is a metal stamping and is attached by sheetmetal screws to the metal vertical channel members of the wall. Each dry-wall anchor accommodates in a horizontally extending portion, the high-strength interengaging portion of the wire formative veneer tie. The securement portion of the ribbon pintles precludes veneer tie pullout. The patterned insertion end of the veneer tie is positioned on the outer wythe and optionally, a continuous reinforcement wire can be snapped into and secured to the outer wythe anchor. The snap-in feature of the anchor here replaces the traditional function of the seismic clip for accommodating a straight wire run (see U.S. Pat. No. 4,875,319) and receiving the open end of the box tie. This anchor and a straight wire run are embedded in the bed joint of the outer wythe.

It is an object of the present invention to provide in an anchoring system having an outer wythe and an inner wythe, a low profile, high-strength partially compressed veneer tie that interengages a wall anchor which system further includes specially configured partially compressed pintles and a patterned insertion portion in the veneer tie.

It is another object of the present invention to provide a specialized veneer tie that is partially compressively reduced at specific locations along the veneer tie to provide a high strength interlock between the anchor and the outer wythe.

It is another object of the present invention to provide labor-saving devices to simplify seismic and non-seismic high-strength installations of brick and stone veneer and the securement thereof to an inner wythe.

It is yet another object of the present invention to provide a cold worked wire formative that is characterized by high resistance to compressive and tensile forces.

It is a further object of the present invention to provide an anchoring system for cavity walls comprising a limited number of component parts that are economical of manufacture resulting in a relatively low unit cost.

It is yet another object of the present invention to provide an anchoring system which restricts lateral and horizontal movements of the facing wythe with respect to the inner wythe but remains adjustable vertically.

It is a feature of the present invention that when the veneer tie is inserted into the receptors therefor, the interconnection points are oriented so that the widest portion thereof is subjected to compressive to tensile forces.

It is another feature of the present invention that the veneer ties are utilizable with either a masonry block having aligned or unaligned bed joints or with a dry wall construct that secures to a metal stud.

It is yet another feature of the present invention that the compressed veneer tie insertion portion is patterned to securely hold to the mortar joint and increase the veneer tie strength.

It is another feature that the close control of the overall height of the veneer tie insertion portion permits the mortar of the bed joints to flow over and about the veneer ties.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
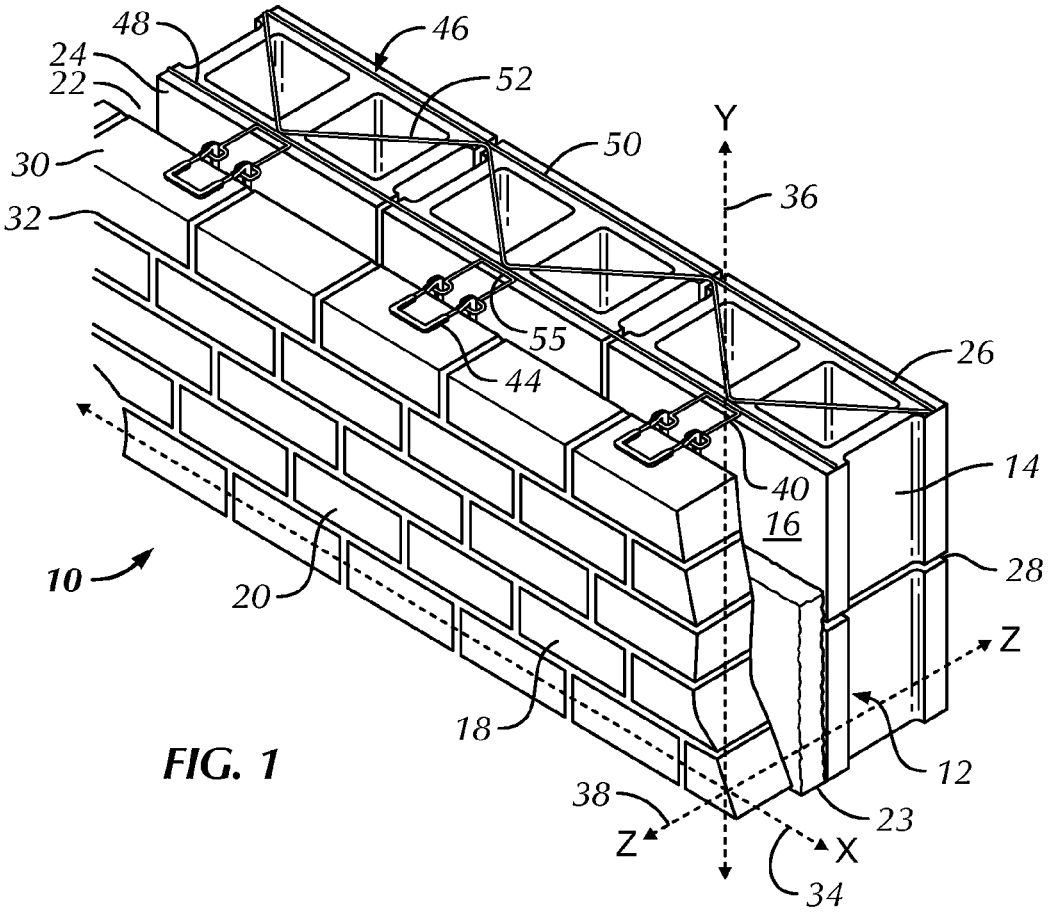
FIG. 1 is a perspective view of an anchoring system having a partially compressed patterned veneer tie of this invention interengaged with a welded wall anchor and shows a wall with an inner wythe of masonry block and an outer wythe of brick veneer.
Figure 3:
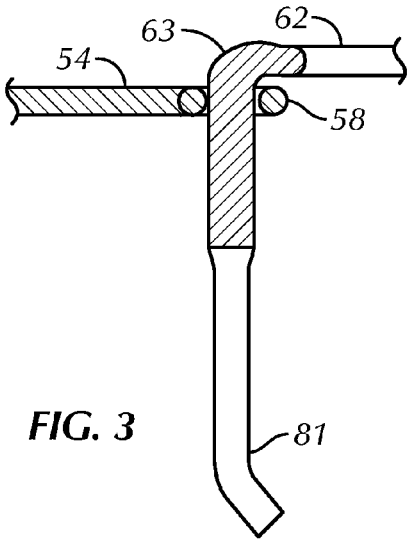
FIG. 3 is a partial cross-sectional view of the anchoring system of FIG. 1 on a substantially vertical plane showing one of the receptor portions of the wall anchor of FIG. 1 and one of the interengaging portions of the veneer tie.
Figure 2:
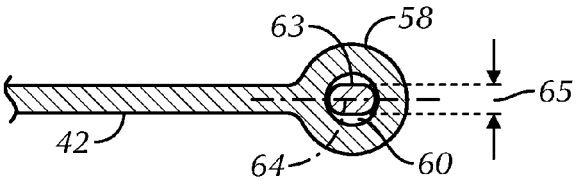
FIG. 2 is a partial cross-sectional view of the anchoring system of FIG. 1 on a substantially horizontal plane showing one of the receptor portions of the wall anchor of FIG. 1 and one of the interconnecting portion of the veneer tie.

In the embodiments described herein, the interengaging portion and the insertion portion of the wire formative components of the veneer ties are cold-worked or otherwise partially flattened and specially configured resulting in greater tensile and compressive strength and thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

Before proceeding to the detailed description, the following definitions are provided. For purposes of defining the invention at hand, a compressively reduced wire formative is a wire formative that has been compressed by cold working so that the resultant body is substantially semicircular at the edges and has flat surfaces therebetween. In use, the rounded edges are aligned so as to receive compressive forces transmitted from the veneer or outer wythe, which forces are generally normal to the facial plane thereof. In the discussion that follows the width of the compressed interengaging portion is also referred to as the major axis and the thickness is referred to as the minor axis.

As the compressive forces are exerted on the compressed portion, the compressed portion withstand forces greater than uncompressed portions of the wire formative formed from the same gage wire. Data reflecting the enhancement represented by the cold-worked compressed portion is included hereinbelow.

The description which follows is of two embodiments of anchoring systems utilizing the high-strength wire formative veneer tie devices of this invention, which devices are suitable for nonseismic and seismic cavity wall applications. Although each high-strength veneer tie is adaptable to varied inner wythe structures, the embodiments here apply to cavity walls with masonry block inner wythes and dry wall (sheetrock) inner wythes. The wall anchor of the first embodiment is adapted from that shown in U.S. Pat. No. 6,789,365 of the inventors hereof. For the masonry structures, mortar bed joint thickness is at least twice the thickness of the embedded anchor.

In accordance, with the *Building Code Requirements for Masonry Structures, ACI* 530-05/*ASCE* 5-05/*TMS* 402-05, Chapter 6, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

Referring now to FIGS. 1 through 8 and 11, the first embodiment of the anchoring system hereof including a compressed wire formative veneer tie of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from the surface 24 of the backup wall 14. Optionally, the cavity is filled with insulation 23.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint 26 and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and along the x-axis. The device 10 includes a wall anchor 40 constructed for embedment in bed joint 26, which, in turn, includes a free end 42 with one or more legs or receptor portions 54 extending into cavity 22. Further, the device 10 includes a wire formative veneer tie or anchor 44 for embedment in bed joint 30.

Figure 4:
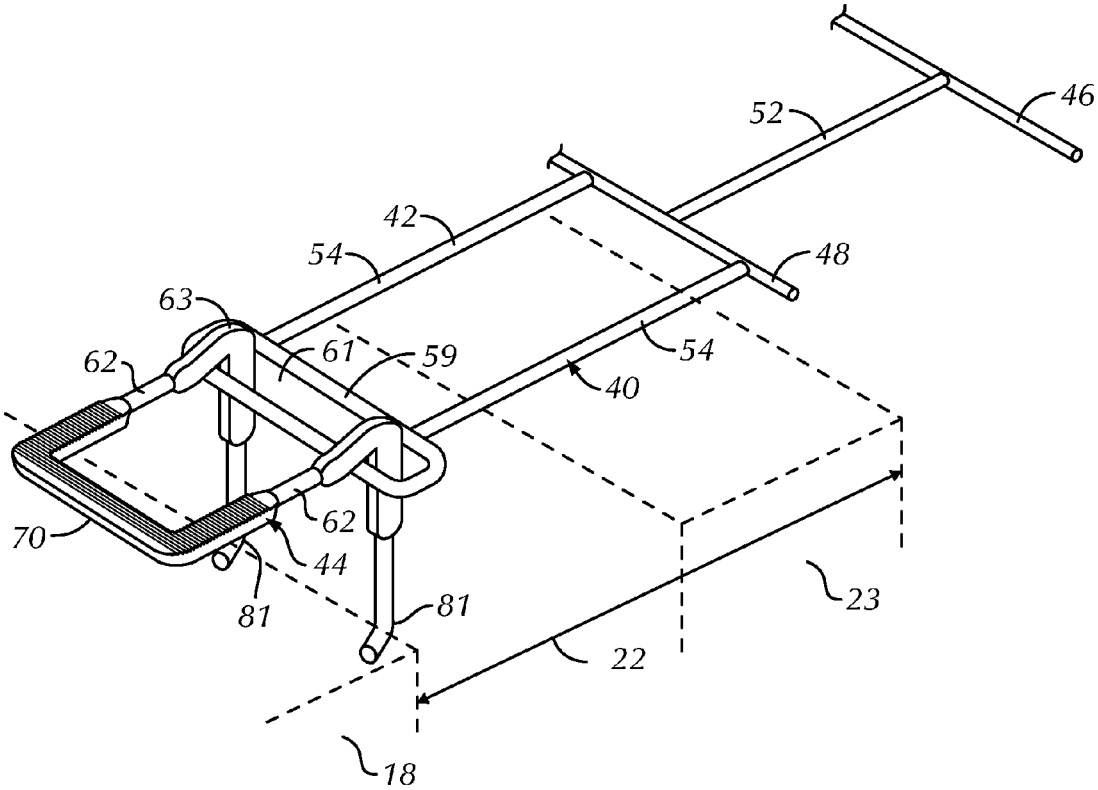
FIG. 4 is a perspective view of the veneer tie of FIG. 1 showing details of the veneer tie secured within a ladder reinforcement anchoring system having a single receptor portion.
Figure 5:
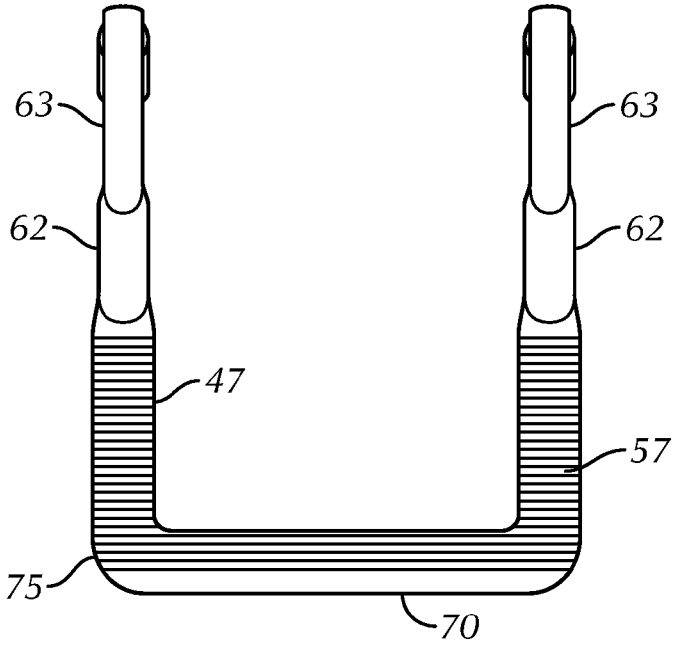
FIG. 5 is a top plan view of the veneer tie of this invention.
Figure 6:
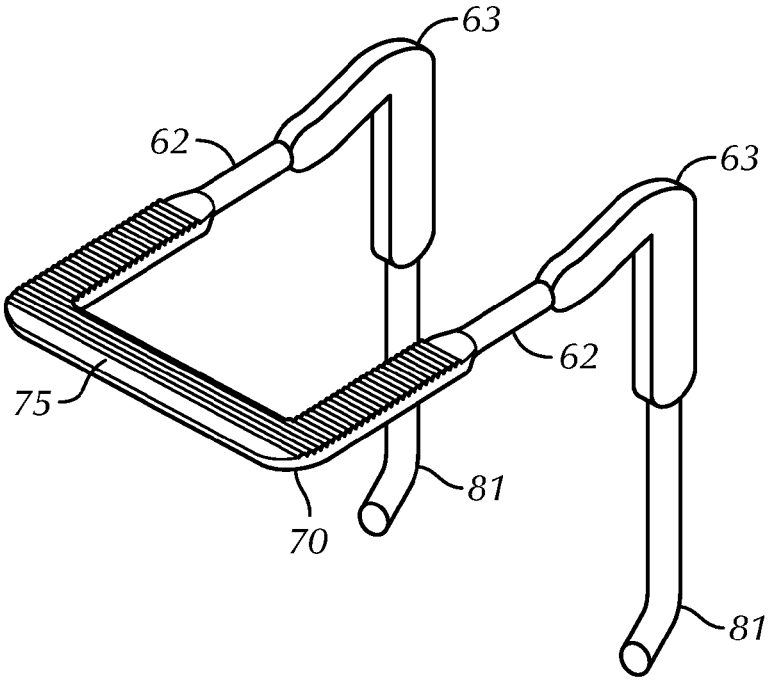
FIG. 6 is a perspective view of the veneer tie of this invention.
Figure 7:
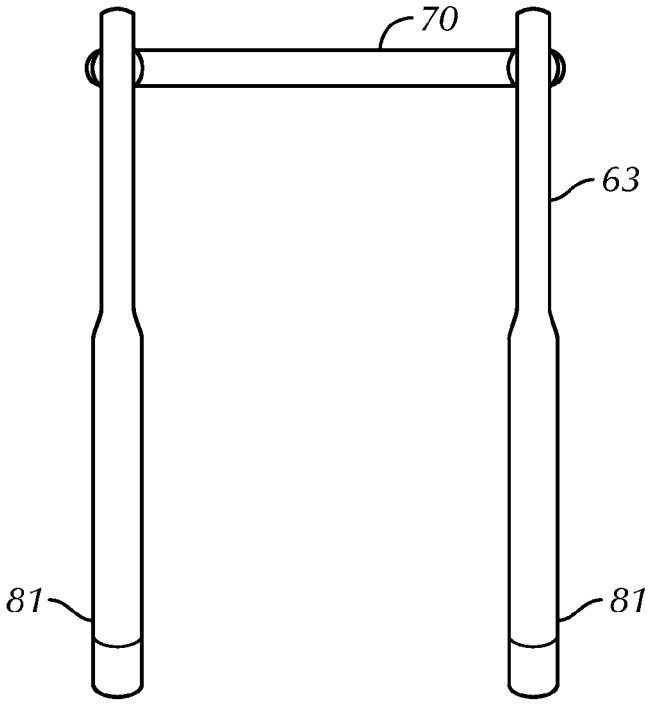
FIG. 7 is a rear elevational view of the veneer tie of this invention.
Figure 8:
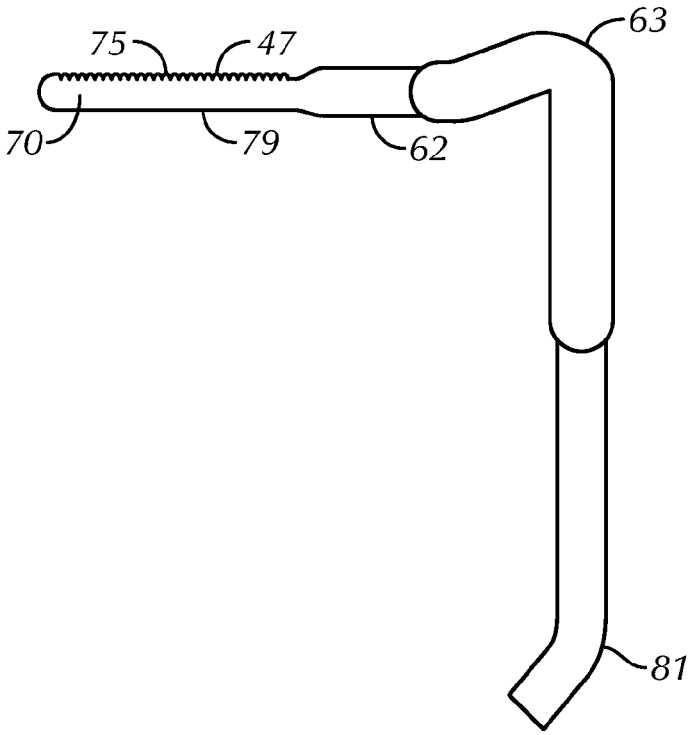
FIG. 8 is a side elevational view of the veneer tie of this invention.
Figure 9:
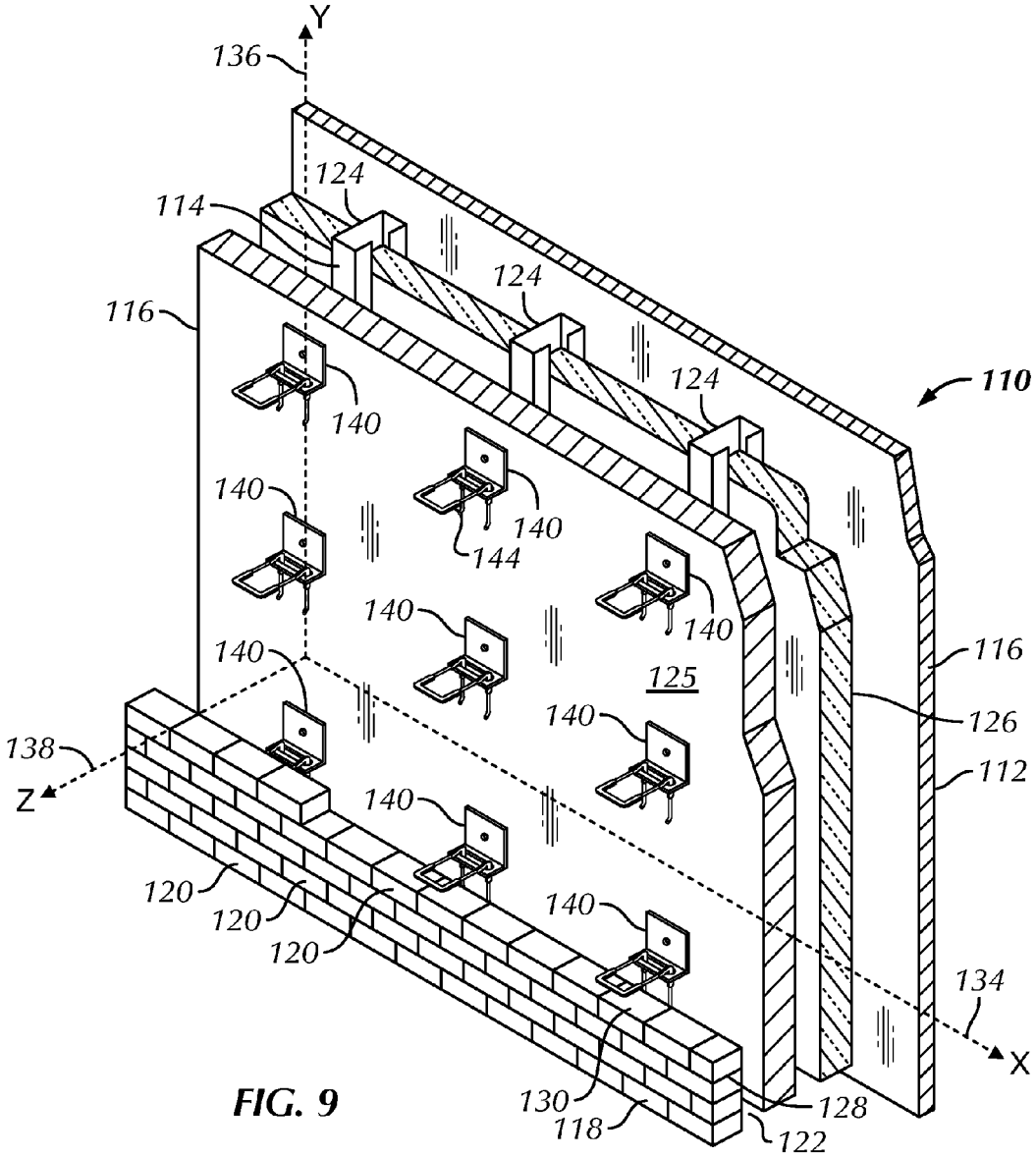
FIG. 9 is a perspective view of this invention having a partially compressed, patterned veneer tie of this invention, wherein the building system therefor includes a sheetmetal anchor for a drywall inner wythe.

The wall anchor 40 is shown in FIGS. 1 and 4 as being emplaced on a course of blocks 16 in preparation for embedment in the mortar of bed joint 26. A truss-type wall reinforcement 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming truss-like portions of the reinforcement structure 46. Alternatively, the cross rods are formed in a ladder shaped manner as shown in FIG. 4.

At intervals along the wall reinforcement 46, spaced pairs of transverse wire members or receptor portions 54 are attached thereto at wire member 48. Alternatively, as shown in FIG. 1, the legs 54 are connected with a rear leg 55 and the rear leg 55 is, in turn, attached to the wall reinforcement 46. The free end 42 and the receptor portions 54 extend into cavity 22 to interengage with the veneer tie 44. As will become clear by the description which follows, the spacing between the receptor portions 54 is constructed to limit the x-axis movement of the construct. Each receptor portion 54 has at the end opposite the attachment end an eyelet 58 formed contiguously therewith. The two eyelets 58 are preferably welded closed, and have a substantially circular opening or eye 60.

Upon installation, the eye or aperture 60 of eyelet 58 is constructed to be within a substantially horizontal plane normal to exterior surface 24. The aperture 60 is dimensioned to accept the securement portion 81 and the interengaging portion 63 of the veneer tie or anchor 44 therethrough and has a slightly larger opening than that required to accommodate the compressed portion. This relationship minimizes the movement of the construct in and along a z-vector and in an xz-plane. For positive engagement, the aperture 60 of eyelet 58 is sealed, through welding or similar method, forming a closed loop. Alternatively, the receptor portions 54 have at the end opposite the attachment end a single elongated eyelet 59 disposed substantially horizontal in the cavity. The single eyelet 59 is welded closed and has a substantially oval opening or eye 61 with a predetermined diameter. The eye 61 is dimensioned to accept an interengaging portion 63 of the veneer tie or anchor 44 therethrough and has a slightly larger opening than that required to accommodate the interengaging portion 63. When engaged, the major cross-sectional axes 65 of the interengaging portions 63 are substantially parallel to the longitudinal axes 64 of the wall anchor receptor portions 54. This relationship minimizes the movement of the construct in and along a z-vector and in an xz-plane.

The veneer tie 44 is, when viewed from a top or bottom elevation, generally U-shaped and is dimensioned to be accommodated by the pair of eyelets 58 or a single eyelet 59 as previously described. The tie 44 has an insertion portion 70 disposed in the bed joint 30 and a cavity portions 62 that engages the anchor 40. The cavity portions 62 extend from the insertion portion 70 into the cavity 22. Two interengaging portions 63 are contiguous with the cavity portions 62 and extend into securement portions 81. The veneer tie 44 is a wire formative and the interengaging portions are partially compressively reduced and depend therefrom at substantially a 90 degree angle. As more clearly seen in FIGS. 2 and 3, the interengaging portion 63 has been compressively reduced so that, when viewed as installed, the cross-section, taking in a horizontal or an xz-plane that includes the longitudinal axis of the receptor 58, shows the greatest dimension substantially oriented along a z-vector. Similarly, when viewed as installed, the cross-section, taking in a vertical plane that includes the longitudinal axis of the receptor portion 54, shows the major axis dimension substantially oriented along a z-vector. Two securement portions 81 are contiguous with the interengaging portions 63 and curved at a substantially 150 degree angle to deter veneer tie pullout.

The veneer tie 44 is more fully shown in FIGS. 5 through 8 and 10. The tie 44 is a wire formative constructed from mill galvanized, hot-dip galvanized, stainless steel or other similar high-strength material and has an insertion portion 70 having an upper surface 75 and a lower surface 79 for disposition in the bed joint 30. The upper surface 75 is compressibly deformed and has a pattern 47 of recessed areas or corrugations 57 impressed thereon for receiving mortar within the recessed areas 57. The insertion portion 70 is configured to maximize surface contact with the mortar in the bed joint 30. The insertion portion 70 of the veneer tie 44 is a wire formative formed from a wire having a diameter substantially equal to the predetermined height of the mortar joint. Upon compressible reduction in height, the insertion portion 70 is mounted upon the exterior wythe and positioned to receive mortar thereabout. The insertion portion 70 retains the mass and substantially the tensile strength as prior to deformation. The vertical height of the insertion portion 70 is reduced so that, upon installation, mortar of bed joint 30 flows around the insertion portion 70.

Upon compression, a pattern or corrugation 57 is impressed on insertion portion 70 and, upon the mortar of bed joint 30 flowing around the insertion portion 70, the mortar flows into the corrugation 57. For enhanced holding, the corrugations 57 are, upon installation, substantially parallel to x-axis 34. In this embodiment, the pattern 47 is shown impressed on only one side thereof; however, it is within the contemplation of this disclosure that corrugations or other patterning could be impressed on other surfaces of the insertion portion 70. Other patterns such as a waffle-like, cellular structure and similar structures optionally replace the corrugations. With the veneer tie 44 constructed as described, the veneer tie 44 is characterized by maintaining substantially all the tensile strength as prior to compression while acquiring a desired low profile.

Figure 10:
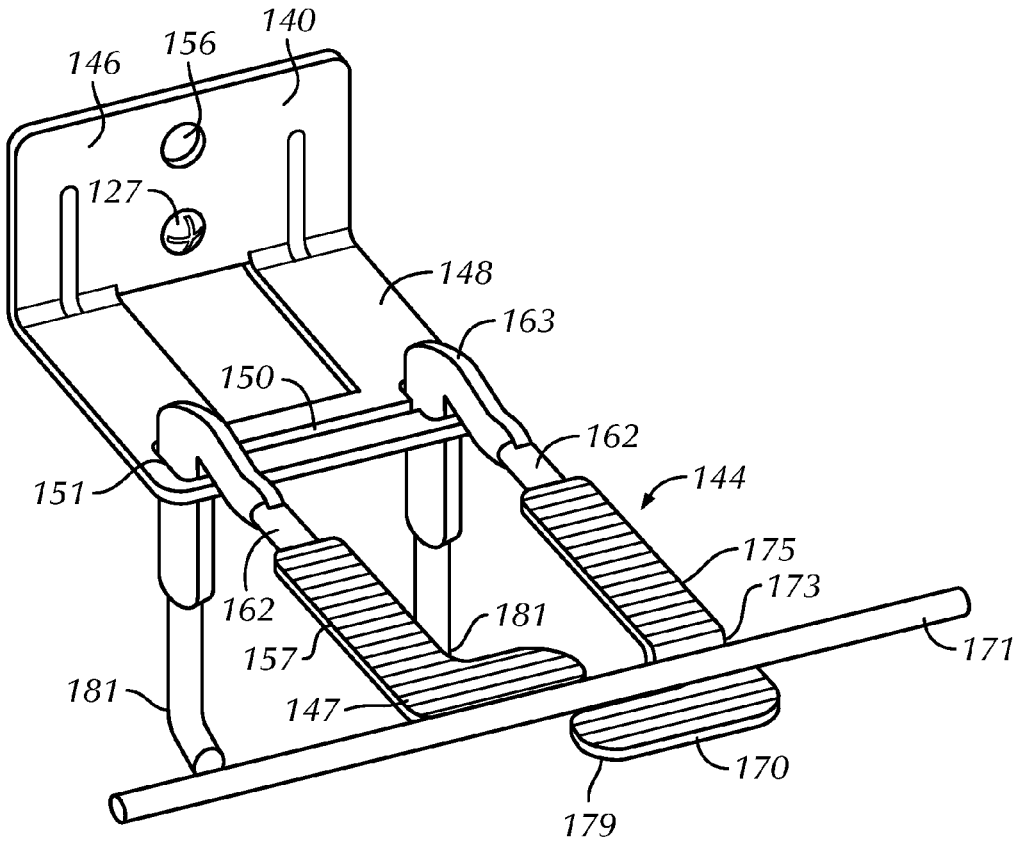
FIG. 10 is a perspective view of the veneer tie of FIG. 9 with a reinforcement wire set within a modified veneer tie; and, FIG. 11 is a cross-sectional view of cold-worked wire used in the formation of the partially compressively reduced veneer tie hereof and showing resultant aspects of continued compression.

The insertion portion 70 is optionally configured (as shown in FIG. 10) to accommodate therewithin a reinforcement wire or straight wire member 171 of predetermined diameter. The insertion portion 70 has a compression 173 dimensioned to interlock with the reinforcement wire 171. With this configuration, the bed joint height specification is readily maintained and the reinforcing wire 171 interlocks with the veneer tie 44 within the 0.300-inch tolerance, thereby forming a seismic construct.

The cross-sectional illustrations show the manner in which wythe-to-wythe and side-to-side movement is limited by the close fitting relationship between the compressively reduced interengaging portion 63 and the receptor openings 60, 61. The minor axis of the compressively reduced interengaging portion 63 is optimally between 30 to 75% of the diameter of the 3/16 inch wire formative and when reduced by one-third has a tension and compression rating of at least 130% of the original wire formative material. The interengaging portion 63, once compressed, is ribbon-like in appearance; however, maintains substantially the same cross sectional area as the wire formative body. Optimally, the insertion portion 70 is fabricated from 0.250-inch diameter wire and compressively reduced to a height of 0.175 inches.

The description which follows is of a second embodiment of the high-strength anchoring system. For ease of comprehension, where similar parts are used reference designators "100" units higher are employed. Thus, the veneer tie 144 of the second embodiment is analogous to the veneer tie 44 of the first embodiment.

Referring now to FIGS. 5 through 11, the second embodiment of the high-strength anchoring system is shown and is referred to generally by the numeral 110. The system 110 employs a sheetmetal wall anchor 140. The dry wall structure 112 is shown having an interior wythe 114 with wallboard 116 as the interior and exterior facings thereof. An exterior or outer wythe 118 of facing brick 120 is attached to dry wall structure 112 and a cavity 122 is formed therebetween. The dry wall structure 112 is constructed to include, besides the wallboard facings 116, vertical channels 124 with insulation layers 126 disposed between adjacent channel members 124. Selected bed joints 128 and 130 are constructed to be in cooperative functional relationship with the veneer tie described in more detail below.

For purposes of discussion, the exterior surface 125 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a dry wall anchor 140 constructed for attachment to vertical channel members 124, for embedment in joint 130 and for interconnecting with the veneer tie 144.

Reference is now directed to the L-shaped, surface-mounted sheetmetal bracket or wall anchor 140 comprising a mounting portion or base plate member 146 and free end projecting or extending portion 148 into the cavity 122. The projecting or extending portion 148 is contiguous with the base plate member 146 so as to have, upon installation, a horizontally disposed elongated aperture 150 which, as best seen in FIG. 10, provides for wire-tie-receiving receptors 151. The aperture 150 is formed in plate member 146. Upon installation, the projecting portion 148 is thus disposed substantially at right angles with respect to the plate member 146. To ease tolerance, receptors 151 may be slightly elongated along the x-axis thereof. The plate member 146 is also provided with mounting holes 156 at the upper and lower ends thereof.

As is best seen in FIG. 10, the projecting portion 148 is spaced from the plate member 146 and adapted to receive the interengaging 163 and securement portions 181 of veneer tie 144 therewithin. In the fabrication of the dry wall as the inner wythe of this construction system 110, the channel members 124 are initially secured in place. In this regard, the channel members 124 may also comprise the standard framing member of a building. Sheets of exterior wallboard 116, which may be of an exterior grade gypsum board, are positioned in abutting relationship with the forward flange of the channel member 124. While the insulating layer 126 is shown as panels dimensioned for use between adjacent column 124, it is to be noted that any similarly suited rigid of flexible insulating material may be used herein with substantially equal efficacy.

After the initial placement of the flexible insulation layer 126 and the wallboard 116, the veneer anchors 140 are secured to the surface of the wallboard 116 in front of channel members 124. Thereafter, sheetmetal screws 127 are inserted into the mounting holes 156 to fasten the anchor 140 to the channel member 124.

The veneer tie 144 is, when viewed from a top or bottom elevation, generally U-shaped and is dimensioned to be accommodated within the anchor aperture 150 as previously described. The tie 144 has an insertion portion 170 disposed in the bed joint 130 and cavity portions 162. The cavity portions 162 extend from the insertion portion 170 into the cavity 122. Two interengaging portions 163 are contiguous with the cavity portions 162 and extend into securement portions 181. The veneer tie 144 is a wire formative and the interengaging portions 163 are partially compressively reduced and curved at a 90 degree angle. The interengaging portion 163 has been compressively reduced so that, when installed, the interengaging portion 163 is in a close fitting functional relationship with the opening of the aperture 151 and the major cross-section axes of the interengaging portions 163 are substantially normal to the wallboard panels 117. Two securement portions 181 are contiguous with the interengaging portions 163 and curved at a substantially 150 degree angle to deter veneer tie pullout.

The veneer tie 144 is more fully shown in FIGS. 5 through 8 and 10. The tie 144 is a wire formative constructed from mill galvanized, hot-dip galvanized, stainless steel or other similar high-strength material and has an insertion portion 170 having an upper surface 175 and a lower surface 179 for disposition in the bed joint 130. The upper surface 175 is compressibly deformed and has a pattern 147 of recessed areas or corrugations 157 impressed thereon for receiving mortar within the recessed areas 157. The insertion portion 170 is configured to maximize surface contact with the mortar in the bed joint 130. The insertion portion 170 of the veneer tie 144 is a wire formative formed from a wire having a diameter substantially equal to the predetermined height of the mortar joint. Upon compressible reduction in height, the insertion portion 170 is mounted upon the exterior wythe positioned to receive mortar thereabout. The insertion portion 170 retains the mass and substantially the tensile strength as prior to deformation. The vertical height of the insertion portion 170 is reduced so that, upon installation, mortar of bed joint 130 flows around the insertion portion 170.

Upon compression, a pattern or corrugations 157 is impressed on insertion portion 170 and, upon placement of the mortar in bed joint 130, the mortar flows around the insertion portion 174 and into the corrugation 157. For enhanced holding, the corrugations 157 are, upon installation, substantially parallel to x-axis 134. In this embodiment, the pattern 147 is shown impressed on only one side thereof; however, it is within the contemplation of this disclosure that corrugations or other patterning could be impressed on other surfaces of the insertion portion 170. Other patterns such as a waffle-like, cellular structure and similar structures optionally replace the corrugations. With the veneer tie 144 constructed as described, the veneer tie 144 is characterized by maintaining substantially all the tensile strength as prior to compression while acquiring a desired low profile.

The minor axis of the compressively reduced interengaging portion 163 is optimally between 30 to 75% of the diameter of the 3/16 inch wire formative and when reduced by one-third has a tension and compression rating of at least 130% of the original wire formative material. The interengaging portion 163, once compressed, is ribbon-like in appearance; however, maintains substantially the same cross sectional area as the wire formative body. Optimally, the insertion portion 170 is fabricated from 0.250-inch diameter wire and compressively reduced to a height of 0.175 inches.

The insertion portion 174 is optionally configured (as shown in FIG. 10) to accommodate therewithin a reinforcement wire or straight wire member 171 of predetermined diameter. The insertion portion 174 has a compression 173 dimensioned to interlock with the reinforcement wire 171. With this configuration, the bed joint height specification is readily maintained and the reinforcing wire 171 interlocks with the veneer tie 144 within the 0.300-inch tolerance, thereby forming a seismic construct. With this configuration the bed joint height specification is readily maintained. As differentiated from the first embodiment, the dry wall construction system 110 provides for the structural integrity by the securement of the veneer anchor construction to the channel member. The anchoring system hereof meets building code requirements for seismic construction and the wall structure reinforcement of both the inner and outer wythes exceeds the testing standards therefor.

Figure 11:
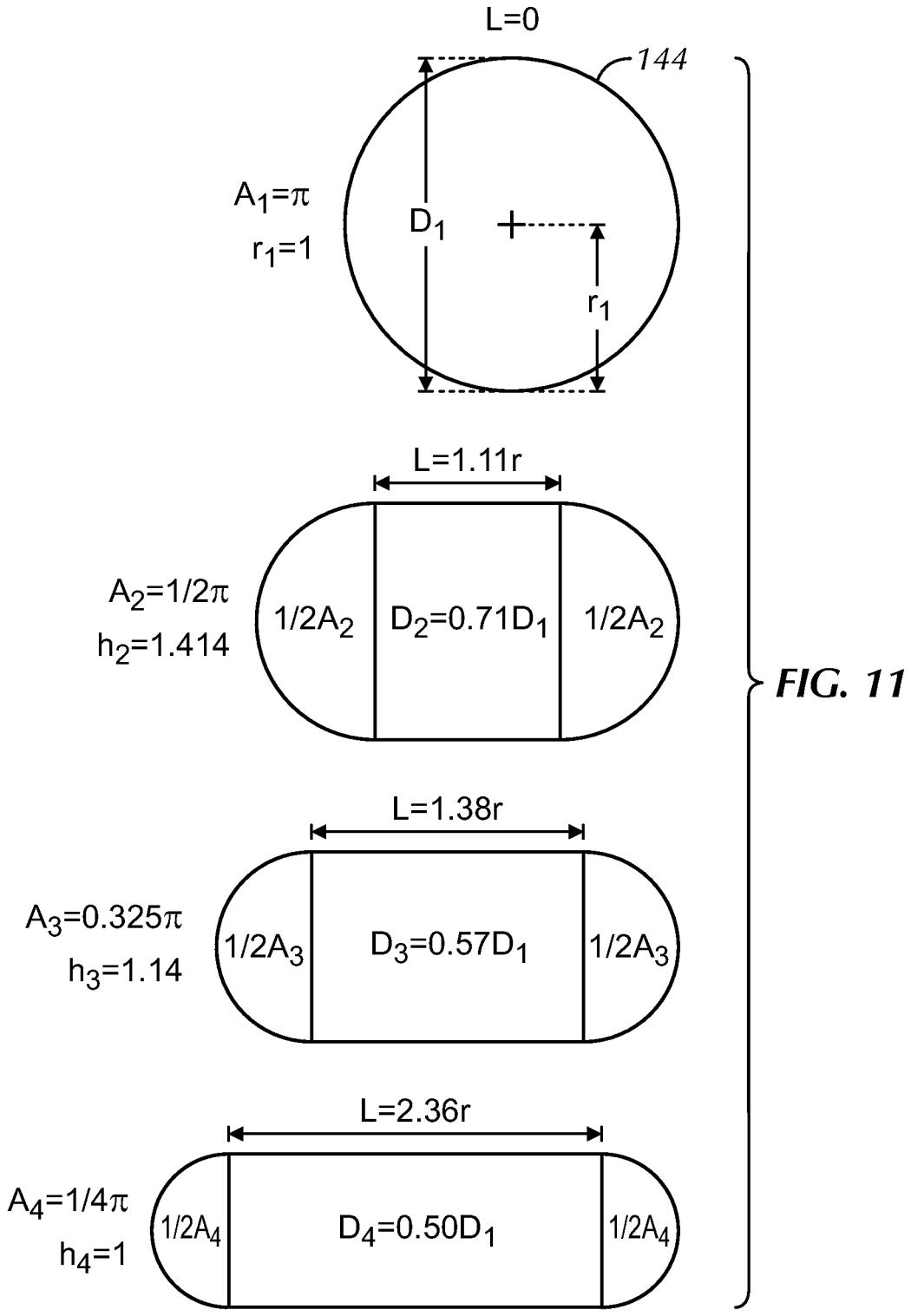

In FIG. 11, the compression of wire formatives is shown schematically. For purposes of discussion, the elongation of the compressed wire is disregarded as the elongation is negligible and the cross-sectional area of the construct remains substantially constant. Here, the veneer tie 144 is formed from 0.187-inch diameter wire. The interengaging portion 163 is reduced up to 75% of original diameter to a thickness of 0.113 inch.

Analytically, the circular cross-section of a wire provides greater flexural strength than a sheetmetal counterpart. In the embodiments described herein the interengaging portion of the veneer tie 144 is cold-worked or partially flattened so that the specification is maintained and high-strength portions are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 11. The deformed body has substantially the same cross-sectional area as the original wire. In each example in FIG. 11, progressive deformation of a wire is shown. Disregarding elongation and noting the prior comments, the topmost portion shows the original wire having a radius, $r1=1$; and area, $A1=\Pi$; length of deformation, $L=0$; and a diameter, D1. Upon successive deformations, the illustrations shows the area of circular cross-section bring progressively ½, ⅜ and ¼ of the area, A1, or $A2=\frac{1}{2}\Pi$; $A3=\frac{3}{8}\Pi$; and $A4=\frac{1}{4}\Pi$, respectively. With the first deformation, the rectangular portion has a length $L=1.11r$ (in terms of the initial radius of 1); a height, $h2=1.14$; ($D2=0.71D1$, where D=diameter); and therefore has an area of approximately $\frac{1}{2}\Pi$. Likewise, with the second deformation, the rectangular portion has a length, $L=1.38r$; a height, $h3=1.14$; a diameter $D3=0.57D1$; and therefore has an area of approximately $\frac{5}{8}\Pi$. Yet again, with the third deformation, the rectangular portion has a length, $L=2.36r$; a height $h4=1$; a diameter, degree of plastic deformation to remain at a 0.300 inch (approx.) combined height for the truss and wall tie can, as will be seen hereinbelow, be used to optimize the high-strength anchoring system.

In testing the high-strength veneer tie described hereinabove, the test protocol is drawn from ASTM Standard E754-80 (Reapproved 2006) entitled, Standard Test Method for Pullout Resistance of Ties and Anchors Embedded in Masonry Mortar Joints. This test method is promulgated by and is under the jurisdiction of ASTM Committee E06 on Performance of Buildings and provides procedures for determining the ability of individual masonry ties and anchors to resist extraction from a masonry mortar joint.

In forming the partially compressively reduced portion, the wire body of up to 0.375-inch in diameter is compressed up to 75% of the wire diameter. When compared to standard wire formatives having diameters in the 0.172- to 0.195-inch range, the partially compressively reduced portion by one-third from the same stock as the standard tie showed upon testing a tension and compression rating that was at least 130% of the rating for the standard tie.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength wire-formative veneer tie for use with an anchoring system in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said wire formative veneer tie comprising:

an insertion portion for disposition in said bed joint of said outer wythe, said insertion portion having an upper surface and a lower surface, said upper surface being compressibly deformed and having a pattern of recessed areas impressed thereon for receiving mortar therewithin;

two cavity portions contiguous with said insertion portion;

two interengaging portions contiguous with said cavity portions and set opposite said insertion portion, said two interengaging portions each being compressively reduced and depend therefrom at a substantially 90 degree angle; and, two securement portions contiguous with said interengaging portions opposite said cavity portion, said two securement portions each curved at a substantially 150 degree angle.

2. A high-strength veneer tie as described in claim 1, wherein said two interengaging portions are compressively reduced in thickness by up to 75% of the original wire formative diameter thereof.

3. A high-strength veneer tie as described in claim 2, wherein said two interengaging portions are fabricated from 0.177- to 0.312-inch diameter wire and when reduced by one-third have a tension and compression rating at least 130% of the rating for a non-reduced wire.

4. A high-strength veneer tie as described in claim 3, wherein said veneer tie insertion portion further comprises:

a compression dimensioned to interlock with a reinforcement wire; and a reinforcement wire disposed in said compression;

whereby upon insertion of said reinforcement wire in said compression a seismic construct is formed.

5. A high-strength veneer tie as described in claim 1, wherein said insertion portion is fabricated from 0.177- to 0.312-inch diameter wire and wherein said wire formative is compressively reduced to a height of 0.162 to 0.187 inches.

6. A high-strength veneer tie as described in claim 1, wherein said wire formative is selected from the group consisting of mill galvanized, hot-dip galvanized, stainless steel, spring steel, and, high- and low-carbon steel.

7. A high-strength wire-formative veneer tie as described in claim 1, wherein each of said interengaging portions has a thickness and a width greater than the thickness.

8. A high-strength anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor configured to be fixedly attached to said inner wythe and having a free end thereof configured for extending into said cavity, said free end of said wall anchor comprising:

one or more receptor portions configured to be disposed in said cavity, said one or more receptor portions being openings disposed substantially horizontal; and, a wire formative veneer tie for insertion within said wall anchor, said veneer tie further comprising:

an insertion portion for disposition in said bed joint of said outer wythe, said insertion portion having an upper surface and a lower surface, said upper surface being compressibly deformed and having a pattern of recessed areas impressed thereon for receiving mortar therewithin, said insertion portion configured to maximize surface contact with said mortar;

two cavity portions contiguous with said insertion portion;

two interengaging portions contiguous with said cavity portions and set opposite said insertion portion, said two interengaging portions each being compressively reduced and curved at a substantially 90 degree angle; and, two securement portions contiguous with said interengaging portions opposite said cavity portion, said two securement portions each curved at a substantially 150 degree angle.

9. A high-strength anchoring system as described in claim 8, wherein said two interengaging portions are compressively reduced in thickness up to 75% of the original diameter thereof.

10. A high-strength anchoring system as described in claim 9, wherein said two interengaging portions are fabricated from a 0.177- to 0.312-inch diameter wire and when reduced by one-third have a tension and compression rating at least 130% of the rating for a non-reduced wire.

11. A high-strength anchoring system as described in claim 10, wherein said inner wythe is a dry wall structure having wallboard panels mounted on columns or framing members, said wall anchor further comprising:

a surface-mounted sheetmetal bracket fixedly attached to said columns of said inner wythe, said sheetmetal bracket being L-shaped and having a mounting portion and an extending portion for extending substantially horizontally into said cavity, said extending portion with said one or more receptor portions therethrough.

12. A high-strength anchoring system as described in claim 11, wherein said one or more receptors further comprise an elongated aperture shaped substantially similar to the cross section of said two interengaging portions.

13. A high-strength anchoring system as described in claim 12, wherein said width of said two interengaging portions are in a close fitting functional relationship with the opening of said aperture.

14. A high-strength anchoring system as described in claim 13, wherein when the veneer tie is installed in the wall a width of each of said two interengaging portions is substantially normal to said wallboard panels.

15. A high-strength anchoring system as described in claim 14, wherein said veneer tie insertion portion further comprises:

a compression dimensioned to interlock with a reinforcement wire; and a reinforcement wire disposed in said compression;

whereby upon insertion of said reinforcement wire in said compression a seismic construct is formed.

16. A high-strength anchoring system as described in claim 9, wherein said inner wythe is formed from successive courses of masonry block with a bed joint of predetermined height between each two adjacent courses and having a reinforcement ladder or truss in said bed joint, said wall anchor further comprising:

a wire formative fixedly attached to said reinforcement having at least two legs extending into and terminating within said cavity.

17. A high-strength anchoring system as described in claim 16, wherein said one or more receptor portions further comprise two eyelets spaced apart at a predetermined intervals and welded closed to form substantially circular openings therethrough with a predetermined diameter; and, said two interengaging portions are in a close fitting functional relationship with said diameter of said eyelet.

18. A high-strength anchoring system as described in claim 17, wherein a width of each of said interengaging portions is substantially parallel to the longitudinal axes of said legs of said wall anchor.

19. A high-strength anchoring system as described in claim 16, wherein said one or more receptor portions further comprise a single elongated eyelet disposed substantially horizontally in said cavity.

20. A high-strength anchoring system as described in claim 19, wherein said veneer tie insertion portion further comprises:

a compression dimensioned to interlock with a reinforcement wire; and a reinforcement wire disposed in said compression;

whereby upon insertion of said reinforcement wire in said compression a seismic construct is formed.

21. A high-strength anchoring system as described in claim 8, wherein said insertion portion is fabricated from 0.177- to 0.312-inch diameter wire and wherein said wire formative is compressively reduced to a height of 0.162 to 0.187 inches.

* * * * *